US007293937B2

(12) United States Patent
Fuchs et al.

(10) Patent No.: US 7,293,937 B2
(45) Date of Patent: Nov. 13, 2007

(54) COVER ARRANGEMENT

(75) Inventors: Alfred Fuchs, Hahnstatten (DE); Harald Gilbert, Aarbergen (DE)

(73) Assignee: ACO Severin Ahlmann GmbH & Co. KG, Rendsberg (DE)

( * ) Notice: Subject to any disclaimer, the term of this patent is extended or adjusted under 35 U.S.C. 154(b) by 0 days.

(21) Appl. No.: 10/550,379

(22) PCT Filed: Mar. 24, 2004

(86) PCT No.: PCT/EP2004/003120

§ 371 (c)(1),
(2), (4) Date: Sep. 21, 2005

(87) PCT Pub. No.: WO2004/085754

PCT Pub. Date: Oct. 7, 2004

(65) Prior Publication Data

US 2006/0171778 A1 Aug. 3, 2006

(30) Foreign Application Priority Data

Mar. 25, 2003 (DE) ..... 103 13 361
Aug. 14, 2003 (DE) ..... 103 37 408

(51) Int. Cl.
*E01C 11/22* (2006.01)
*E01F 5/00* (2006.01)

(52) U.S. Cl. ..... 404/2; 404/25

(58) Field of Classification Search ..... 404/2, 404/25, 26

See application file for complete search history.

(56) References Cited

U.S. PATENT DOCUMENTS 4,364,689 A * 12/1982 Dumortier ..... 404/25
4,909,660 A 3/1990 Ferns
5,181,793 A * 1/1993 Dekel ..... 404/4
5,340,232 A * 8/1994 Spiess et al. ..... 404/25
5,864,990 A * 2/1999 Tu ..... 52/19
6,722,813 B2 * 4/2004 Hauer et al. ..... 404/25

FOREIGN PATENT DOCUMENTS

| | | |
|---|---|---|
| DE | 35 23 423 | 1/1987 |
| DE | 36 90 048 | 3/1987 |
| DE | 691 02 404 | 10/1994 |
| DE | 695 20 174 | 1/1996 |
| DE | 299 14 492 | 1/2000 |
| EP | 0 023 380 | 2/1981 |
| EP | 0 085 306 | 8/1983 |
| EP | 0 337 110 | 10/1989 |

(Continued)

*Primary Examiner*—Raymond W Addie
(74) *Attorney, Agent, or Firm*—Hamre, Schumann, Mueller & Larson, PC

(57) ABSTRACT

A cover arrangement for a surface drainage device or similar hollow body is provided that is adapted to be installed in the ground and to be opened. This comprises a rectangular frame to be installed in the ground, a cover that can be inserted into the frame, hinge devices by means of which the cover is retained in the frame so that it can be pivoted upward in an opening direction, and latch devices by means of which the cover can be locked into the frame so that it will not open. These hinges and/or latch devices are constructed as spring-action cast rods and are integrally connected to the cover.

9 Claims, 2 Drawing Sheets

FOREIGN PATENT DOCUMENTS

| | | |
|---|---|---|
| EP | 0 506 591 | 9/1992 |
| EP | 0 280 872 | 9/1998 |
| FR | 2 740 789 | 5/1997 |
| WO | WO 86/04624 | 8/1986 |
| WO | WO-03/027400 A1 * | 4/2003 |
| WO | WO 2004/015213 | 2/2004 |

* cited by examiner

COVER ARRANGEMENT

STATEMENT REGARDING FEDERALLY SPONSORED RESEARCH OR DEVELOPMENT

Not applicable.

RELATED U.S. APPLICATIONS

Not applicable.

REFERENCE TO MICROFICHE APPENDIX

Not applicable.

FIELD OF THE INVENTION

The invention relates to a cover arrangement for a surface drainage device or similar hollow body that can be installed in the ground and is to be opened.

BACKGROUND OF THE INVENTION

Such cover arrangements, for example to be used on street drains or the like, are known. For instance, the patent DE 3523423 C1 discloses a hinged gully top consisting of a frame and a grating, constructed so that hinge bolts can be inserted or screwed into the frame from outside. Hence it is a simple matter to open the grating by means of these hinges. This offers the advantage that, for example during cleaning and maintenance work, the grating does not need to be lifted completely out of the frame, but when necessary can simply be pivoted upward. The result is not only a reduction of the effort expended and the risk of injury during cleaning and maintenance work, but in addition the grating is secured against theft. The disadvantage of this design is that to disassemble the grating, the frame must be exposed in the hinge region in order to provide access to the hinge bolts. This inevitably involves damage to the adjacent pavement surface and hence a not inconsiderable expenditure of effort and materials in order to remove or exchange the grating. Furthermore, with this design the direction in which the cover arrangement is pivoted when raised must already be taken into account during installation, in order to ensure that the raised cover or grating is not opposed to the oncoming vehicles. A grating raised in such a way would seriously endanger the traffic.

Furthermore, in most of the known hinged cover arrangements there is nothing to prevent vandals from raising the grating or cover, because the cover arrangements can usually be tilted up without any special tool. In this case both the grating, projecting upward from the pavement, and the opening thus left in the shaft cover are a major source of danger.

The patent DE 299 14 492 U1 discloses a shaft cover with hinge bolts that are accessible from inside, which offers the advantage that, for example when the cover is being exchanged, the frame need not be exposed in the region where the hinge bolts are being attached. In other respects, this design involves the same disadvantages as the shaft covers previously described.

The patent DE 1834483 U1 discloses a hinge device consisting of 2 joint cogs, each of which lies in a cavity within a separate bracket on a grating. These two brackets are set into corresponding receptacles on the frame, so that the joint cogs lying loosely in the cavity slide partially into corresponding cavities within the frame and thus connect the grating or cover firmly to the frame. The joint cogs here are, for example, spherical in shape and are rolled by gravity into the associated cavities within the frame, or they consist of cylinders supported on springs, which are pressed into the associated frame cavities by the spring force. A disadvantage of this design is that the hinge mechanism for the cover arrangement consists not of a single part but rather of several individual elements. These must be installed in the cover device after it has been cast, which is cost-intensive. Furthermore, the presence of extra parts also increases the likelihood of faults developing, because such parts can be lost, and this system is very vulnerable to dirt, because such small parts (springs, balls) are readily harmed by corrosion and dirt. Another disadvantage is that once the grating has been installed, great effort is required to remove it. And in this design, again, there is the problem that the installation orientation depends on the direction of vehicle travel. If the traffic direction changes, great effort is required to adapt the grating accordingly.

BRIEF SUMMARY OF THE INVENTION

It is the object of the present invention to provide a cover arrangement for a surface drainage device or similar hollow body that can be installed in the ground and is to be opened in such a way that the arrangement is economical as well as simple to manufacture and use.

According to the present invention there is provided a cover arrangement for a surface drainage device or similar hollow body that is adapted to be installed in the ground and to be opened, comprising a rectangular frame adapted for installation in the ground and defining a plurality of insertion openings; a cover adapted for insertion into the frame; hinge devices that retain the cover in the frame and enable the cover to be pivoted upward in an opening direction out of the frame; and latch devices by means of which the cover is adapted to be locked into the frame so that it will not open; at least one of the hinge devices and the latch devices comprising flexible cast rods that are integrally connected to the cover; and the hinge devices and the latch devices both defining projections, at least one of which can be inserted into the insertion openings defined by the frame, as desired.

The essence of the invention resides in the fact that the cover arrangement, consisting of a frame and of a cover that can be inserted into this frame, comprises hinge devices and/or latch devices integrally formed on flexible rods that, in turn, are integrally formed on the cover. Advantageously, the cover consists of cast material, in particular cast iron, preferably spheroidal graphite cast iron. Here the hinge devices serve to provide a pivotable bearing of the cover in the frame, and the latch devices lock the cover to the frame so as to prevent it from unintended opening. In this design, of course, the hinge devices can also be hinge devices such as are already known from the state of the art; conversely, it is of course conceivable for the latch device to be designed in the conventional manner and for only the hinge device to be constructed in accordance with the invention.

The invention exhibits a number of substantial advantages in comparison with cover arrangements known from the state of the art. The implementation of hinge and/or latch devices that are integrally connected with the cover in the form of flexible cast rods is an extremely economical and in addition advantageous solution. For one thing, the number of materials used in manufacturing is reduced to a minimum, and for another the production process comprises distinctly fewer steps. Because the cover arrangement consists of only two individual parts, it is less susceptible to failure, because none of the parts can be lost (for instance, at the construction site). Furthermore, the embodiment according to the present invention is distinctly more resistant than known constructions. For example, failure as a result of corrosion or contamination with dirt would not be expected here.

The construction of the hinge and/or latch device in accordance with the invention offers major advantages with respect to handling of the cover arrangement. The construction of the latch device in accordance with the invention enables rapid and simple opening of the cover device; the construction of the hinge device in accordance with the invention represents an economical and furthermore functionally reliable hinge construction. Installation of the cover in the frame is accomplished very simply and rapidly because the hinge and/or latch devices are constructed as flexible cast rods. The hinge/latch devices need merely be pressed into the corresponding bearing recesses formed in the frame. For this purpose the cover is pressed into the frame, which procedure initially deflects the integrally formed latch or hinge structures and then causes them to become caught in the bearing recesses, thus connecting the cover to the frame. In order to release and open the cover, a releasing tool must be used to apply a force to the flexible rod of the latch device in accordance with the invention in a direction substantially perpendicular to the opening direction. This deflects the flexible rods into a temporary opening position, allowing the latch structures to slide out of the bearing recesses, which enables the cover to swivel open.

Simultaneous employment of the latch and hinge devices in accordance with the invention for a given cover results in a cover arrangement that can be economically manufactured, is resistant and versatile, and can be operated in a simple manner. However, it should be mentioned that if desired, it is also possible to use a cover arrangement in which only one of the two elements in accordance with the invention is combined with an element that is already known from the state of the art—for example, a cover arrangement having latch devices in accordance with the invention as well as conventional hinge devices screwed to the frame, such as are known from the state of the art.

Because the opening mechanism of the latch device in accordance with the invention is concealed, the cover arrangement is also protected from an undesired opening, or opening by unauthorized persons. First, the latch mechanism cannot very easily be identified, and second, it is difficult or impossible to open the cover without a suitable releasing tool. Hence the cover is secured against vandalism and theft; the danger that a cover will be left raised and/or the shaft open unintentionally is significantly reduced.

It is generally the case that in a cover arrangement according to the present invention the frame and the cover not only each consist of a single part, but also can both be made of a single material. This reduces both the costs and the time required for production, because only a small number of processing stages are needed.

A preferred further development is construction of the latch devices in accordance with the invention so that they comprise beveled surfaces for initial contact. Owing to these beveled surfaces the latch device is bent into an opening position by a force that acts on the cover in the opening direction. Release of the cover from the frame is thus simplified. With this further development it is no longer necessary to press the latch projections out of their bearing recess in the frame by lateral pressure on the associated flexible rod. Application of a force in the opening direction causes the projections to slide out of their latched position. Hence the process of releasing the cover becomes even faster and more reliable.

Another embodiment consists in situating hinge devices and latch devices on the cover identically in such a way that the cover can be opened toward either of two sides, as desired. Thus the cover can be manufactured so to speak as a unitary cover, because there is no need to be concerned with a particular opening direction and the associated dispositions of the hinges and latches. This embodiment allows the hinge device to function as both hinge and latch, depending on the side toward which the cover is to be opened. In this case the cover can be opened by rotation about an axis along the two pairs of hinges or latches. Now if a force acts perpendicular to the opening direction, preferably in the region between the two hinges, the hinges or latches can be pressed out of their bearings; in this case, therefore, the hinge device has a latch function. An advantage of this solution in accordance with the invention is that, for example when the traffic flow is altered, there is no need to undertake reconstruction of the cover arrangement, because the cover can be opened toward both sides and hence is independent of the traffic direction.

If the hinge device is constructed such that it can be released from the frame by a force acting substantially perpendicular to the opening direction, complete exchange of the cover can be carried out with no great effort and in the shortest time. To release the connection between frame and cover, the hinge projections can simply be pushed out of the bearing recess by applying lateral pressure to the flexible rods. Thus removal of the entire cover is possible with no need for operations on the frame or the surrounding traffic surface. In addition, the problem of soiled or rusted hinge attachments and locks is eliminated.

The arrangement includes providing the frame with insertion bevels so that either hinge projections or latch projections can be inserted, as desired. These insertion bevels make it easier to put the cover in place. The hinge or latch projections formed on the cover need merely be set onto the insertion bevels and pushed into the corresponding bearing recesses on the frame by gentle pressure. Installation of the cover can be accomplished in this way without a tool, which makes the process of assembly simpler and more economical. Because both the hinge and the latch projections can slide into the associated bearing recesses along these insertion bevels, if the cover is symmetrically constructed the frame can of course also be employed in a direction-independent manner. Furthermore, these slanted insertion surfaces minimize the risk that the latch or hinge devices may strike against the frame edge and break as a result of being carelessly inserted or closed.

Preferably the frame and the cover are provided with contact surfaces that engage one another when the cover is closed. This alleviates the load on the latch or hinge devices, because imposed traffic loads are transferred into the frame by way of these contact surfaces and from there into the substrate. Hence the forces acting here no longer need to be conducted into the frame by way of the projections of the hinge and/or latch devices or other hinge or latch devices constructed according to the state of the art. As a result, the cover arrangement according to the present invention can be installed even in traffic surfaces with very high traffic loads.

If desired, the cover and the frame of the cover arrangement can be provided with lateral apertures. These apertures serve as places in which to set a releasing tool with which the cover can be raised. In this case it is possible to construct these apertures such that only a special, appropriately designed tool can successfully be used to open the cover. This decisively increases the degree to which the cover is secured against theft. Furthermore, of course, the risk that it will be opened by unauthorized persons is also avoided.

It is likewise sensible for the apertures in which a releasing tool is placed to be disposed only at the sides of the cover or the frame where raising of the cover is actually possible. This prevents the releasing tool from being positioned on sides that are not intended to be raised, and thus avoids unintentional damage to hinge devices, because the side on which the cover can be raised is clearly visible.

The frame of the cover arrangement can be made of any adequately solid material, for example metal or plastic. The cover, on the other hand, should preferably be made of spherical graphite cast iron, which surprisingly is sufficiently elastic for these purposes. Naturally, however, it is also possible to use other appropriate materials. Depending on the materials used and their elasticity, the cover arrangement is more or less easy to open. A stiff material results in an opening mechanism that moves with difficulty, whereas the use of more flexible materials produces a more easily operable opening mechanism. Hence by appropriate choice of the material of which the cover is made, the manner of function and/or the locking strength of the opening mechanism can be influenced.

It should be pointed out that the cover arrangement according to the present invention can also have another, non-rectangular shape with respect to its basic outline. The construction of latch and/or hinge devices on flexible rods formed integrally with a over is also possible, for example, with around or oval cover.

Advantageous further developments of the invention are also disclosed.

An embodiment of the invention will now be described by way of example with reference to the accompanying drawings.

DETAILED DESCRIPTION OF THE INVENTION

Figure 1:
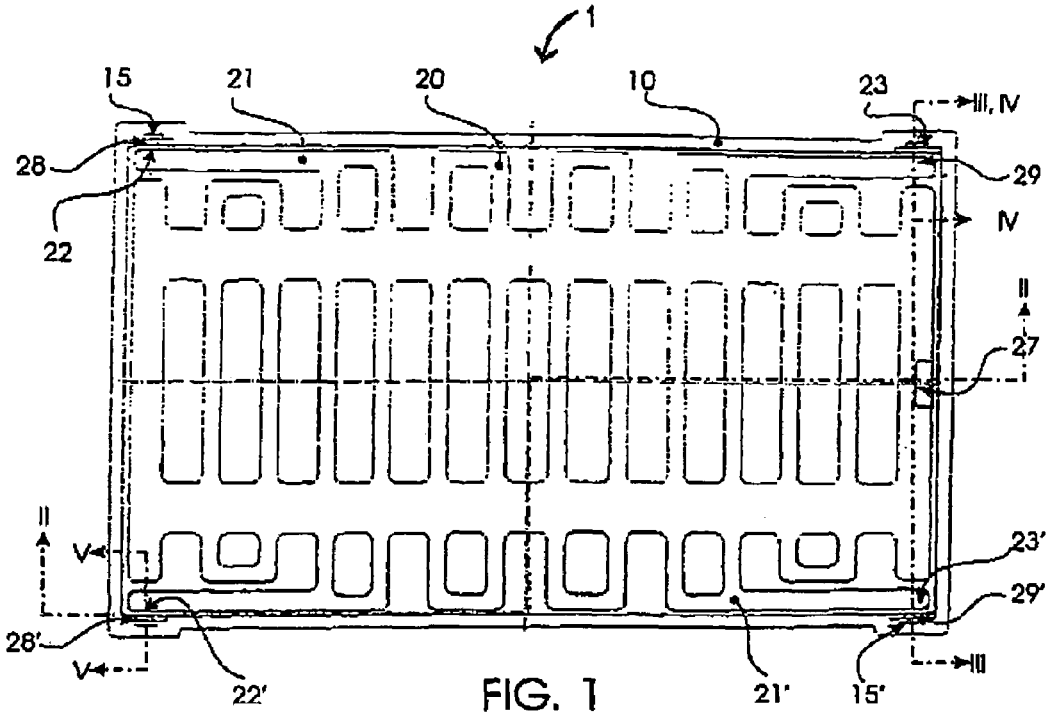
FIG. 1 is a plan view of an embodiment of the invention.

In the following description, the same reference numerals are used for identical parts or parts with identical actions.

FIG. 1 is a plan view of a cover arrangement 1 in one embodiment of the invention. The cover arrangement 1 comprises a frame 10 that can be installed in the ground, a cover 20 that can be inserted into the frame 10, two hinge devices 22, 22' by way of which the cover 20 is retained in the frame 10 so that it can be tilted upward in an opening direction, and latch devices 23, 23' by means of which the cover 20 can be locked to the frame 10 so that it cannot be opened; where the hinge devices 22, 22' and the latch devices 23, 23' are formed on flexible cast rods 21, 21' by way of which they are integrally connected to the cover 20. FIG. 1 additionally shows an aperture 27 for a releasing tool 40, disposed on the side on which the cover 20 can be raised. On all four sides insertion bevels 15, 15' are provided on the frame 10, which enable the cover 20 to be put into place more easily. The hinge projections 28, 28' and/or the latch projections 29, 29' disposed on the side where the latch devices 23, 23' are situated simply slide over these insertion bevels 15, 15' into corresponding bearing recesses 16 in the frame 10 (see FIGS. 3, 4). Also clearly visible in FIG. 1 is the integral construction of the latch and hinge devices 23, 23' and 22, 22', on the cast-iron flexible rods 21, 21' of the cover 20. It should be pointed out that the design of the cover 20 as a grating, shown in FIG. 1, is presented purely as an example. Naturally every other design, for instance as perforated sheet metal or a substantially closed surface, is also possible.

Figure 2:
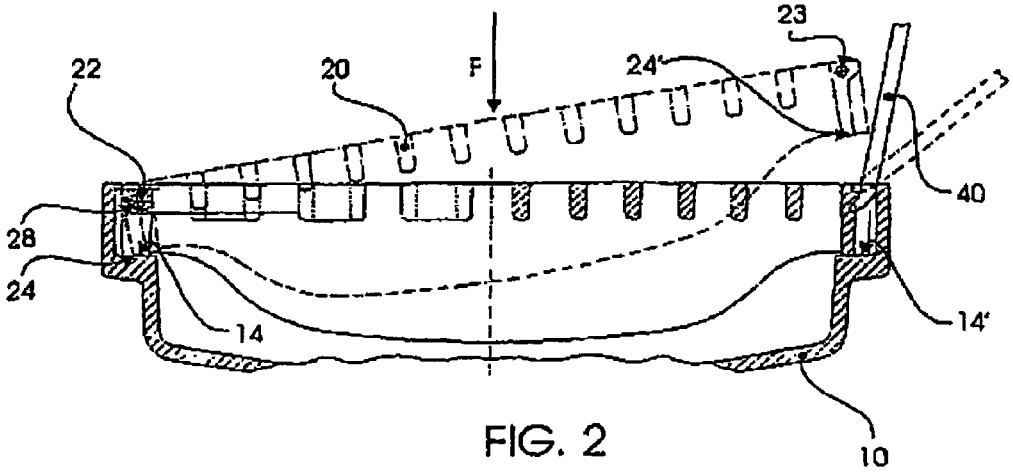
FIG. 2 shows a longitudinal section along the line II-II in FIG. 1.
Figure 3:
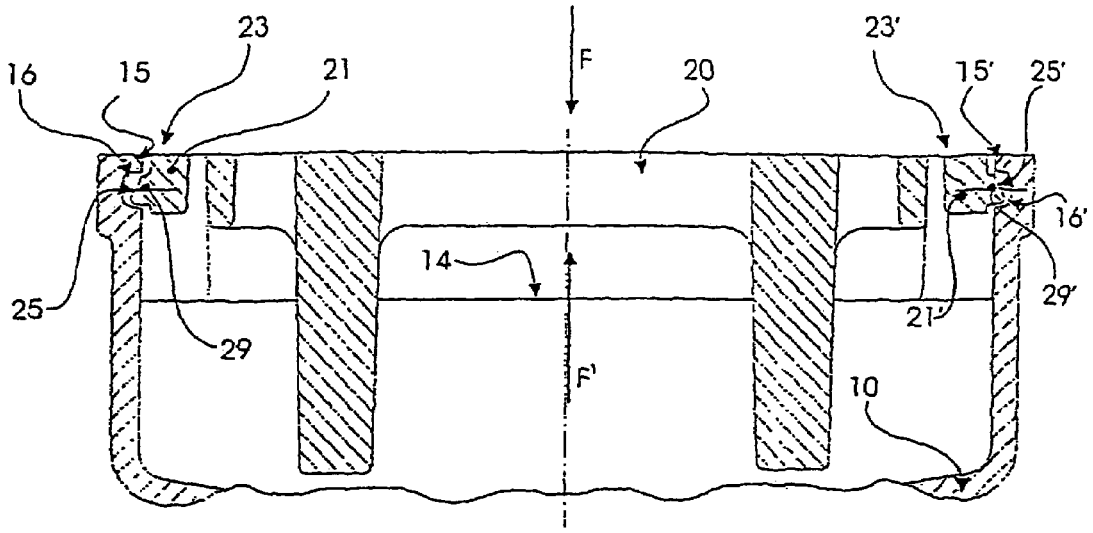
FIG. 3 shows a cross section along the line III-III in FIG. 1.

FIG. 2 shows a cross section along a line II-II through the embodiment according to FIG. 1. The partially opened cover 20, as well as the position of the releasing tool 40 after the cover arrangement 1 has been opened, are represented here by dashed lines. In FIG. 2 it is clear that when traffic loads F are applied, they are not conducted away through the cover 20 into the latch and/or hinge devices, 23 and/or 22; instead, these forces F are transferred by way of seating surfaces 24, 24' on the cover 20 into seating surfaces 14, 14' on the frame 10. The seating surface 14, 14' on the frame 10 is represented in FIG. 2 and FIG. 3 and formed by narrow corbel or shelf. This surface 14, 14' can, of course, also be constructed differently, for example as a small plateau with an area equivalent to that of the corresponding seating surface 24, 24' on the cover 20. This prevents dirt from accumulating on this plateau.

FIG. 3 shows a cross section along the line III-III through the embodiment according to FIG. 1, which makes evident the integral construction of the latch device 23, 23' on the flexible rod 21, 21'. Here slanted carrier surfaces on a latch projection 29, 29' facilitate opening of the cover 20, because imposition of a force $F^1$ in the opening direction causes the latch projections 29, 29' to be pressed out of the bearing recess 16, 16 in the frame 10. The insertion bevels 15, 15' on the frame 10 enable the latch projections 29, 29' on the cover 20 easily to slide into the bearing recesses 16, 16' on the frame 10 when the cover 20 is closed. The numeral 14 designates the seating surface 14' on the frame 10, by way of which the force F exerted by the traffic load is transferred into the frame 10 and from there into the substrate.

Figure 4:
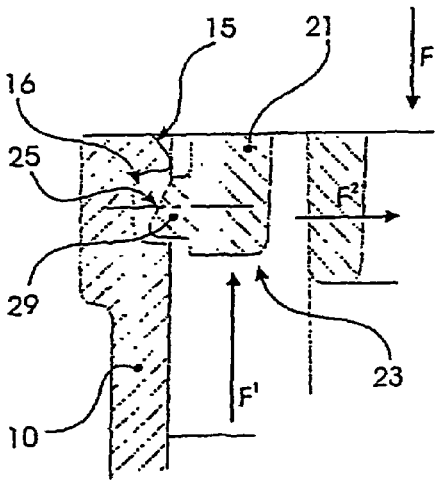
FIG. 4 shows a section along the line IV-IV in FIG. 1.
Figure 5:
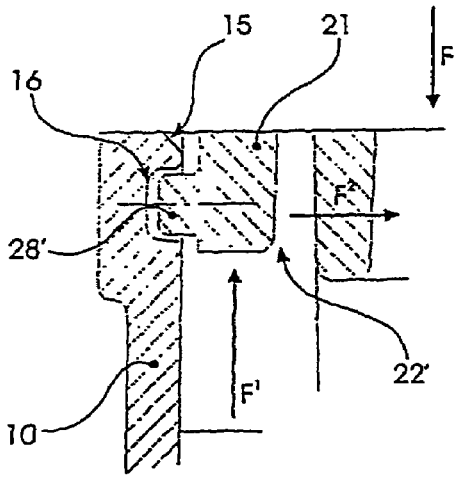
FIG. 5 shows a section along the line V-V in FIG. 1.

In FIGS. 4 and 5 the details of the latch and hinge devices 23 and 22', respectively, are shown in section along the lines IV-IV and V-V in FIG. 1. It is evident here that the hinge device 22' represented in FIG. 5 cannot be released from its anchoring by a force $F^1$ applied as drawn in the figure. Instead, to release the connection between frame 10 and cover 20 a force $F^2$ is needed, which acts on the flexible rod 21 in a direction perpendicular to the traffic load F, i.e. to the opening plane. Such a force pulls the hinge projection 28' out of the bearing recess 16 and releases the cover 20 from the frame 10. In FIG. 4 it is made clear that the force $F^1$ causes opening of the cover 20, because its beveled contact surface 25 allows the latch device 23 to slide out of the associated bearing recess 16 in the frame 10, enabling the cover 20 to open. In this embodiment the hinge device 22', which is made integral with the flexible rod 21, is distinguished from the latch device 23 (likewise integral with a flexible rod 21) merely by the absence of this beveled contact surface 25, which enables sliding out of the bearing recess 16 in the frame 10.

The invention claimed is:

1. Cover arrangement for a surface drainage device or similar hollow body that is adapted to be installed in the ground and to be opened, comprising:

a frame adapted for installation in the ground and defining a plurality of bearing recesses; and a cover releasably insertable into the frame, said frame and said cover together including hinge devices that retain the cover in the frame and enable the cover to be pivoted upward in an opening direction out of the frame and including latch devices which lock the cover to the frame, at least one of the hinge devices and the latch devices having flexible cast rods that are integrally connected to the cover, said flexible cast rods including projections insertable in the bearing recesses of the frame, wherein the cover has a core and the flexible cast rods each have at least one first leg parallel to the pivot axis of the cover, said at least one first leg attaching the respective flexible cast rod to said core, each of said flexible cast rods also each having a second leg in unity with the at least one first leg and perpendicular to the pivot axis of the cover, said flexible cast rods being flexible in a direction approximately parallel with the pivot axis, and wherein the frame and the cover are each substantially rectangular, wherein the flexible cast rods are located at corners of the frame and cover, and wherein the flexible cast rods of said at least one of the hinge devices and the latch devices are symmetrical to one another.

2. Cover arrangement according to claim 1, wherein the latch devices comprise beveled contact surfaces such that in the presence of a force acting on the cover in an opening direction, the latch devices are bent into an opening position.

3. Cover arrangement according to claim 1, wherein the hinge devices and the latch devices are identically shaped and are disposed at identical, symmetrical sites on the cover such that the cover is adapted to open toward either of two sides, as desired.

4. Cover arrangement according to claim 1, wherein the hinge devices are constructed such that they can be released from the frame by a force directed substantially perpendicular to the opening direction.

5. Cover arrangement according to claim 1, wherein the frame and the cover define seating surfaces constructed and disposed such that said seating surfaces are in engagement with one another when the cover is closed.

6. Cover arrangement according to claim 1, wherein an edge of at least one of the cover and the frame is adapted to receive a releasing tool therein.

7. Cover arrangement according to claim 1, wherein at least one of the cover and the frame define on an openable side thereof that is adapted to receive placement of a releasing tool therein.

8. Cover arrangement according to claim 1, wherein the cover is comprised of cast iron.

9. Cover arrangement according to claim 1, wherein the cover is comprised of spherical graphite cast iron.

* * * * *